US010312034B1

(12) United States Patent
Chen et al.

(10) Patent No.: US 10,312,034 B1
(45) Date of Patent: Jun. 4, 2019

(54) KEYBOARD DEVICE

(71) Applicants: Bo-An Chen, Taipei (TW); Chin-Sung Pan, Taipei (TW)

(72) Inventors: Bo-An Chen, Taipei (TW); Chin-Sung Pan, Taipei (TW)

(73) Assignee: PRIMAX ELECTRONICS LTD, Taipei (TW)

( * ) Notice: Subject to any disclaimer, the term of this patent is extended or adjusted under 35 U.S.C. 154(b) by 0 days.

(21) Appl. No.: 15/962,898

(22) Filed: Apr. 25, 2018

(51) Int. Cl.
*H01H 13/704* (2006.01)
*H01H 13/807* (2006.01)
*H01H 13/7065* (2006.01)

(52) U.S. Cl.
CPC ..... *H01H 13/807* (2013.01); *H01H 13/704* (2013.01); *H01H 13/7065* (2013.01)

(58) Field of Classification Search
CPC ..... H01H 13/702; H01H 13/7065; H01H 2205/002; H01H 2211/00; H01H 13/703; H01H 13/785; H01H 2025/046; H01H 2025/048; H01H 2201/026; H01H 2207/004; H01H 2207/008; H01H 2207/01; H01H 2211/02; H01H 2217/012; H01H 2221/012; H01H 2227/018; H01H 2229/004; H01H 2229/016; H01H 2229/038; H01H 2239/01; H01H 2239/012; H01H 2239/02; H01H 25/04; H01H 25/041; H01H 3/125
USPC ..... 200/5 A, 314, 341.512; 341/22, 20, 26, 341/24, 176, 27, 33
See application file for complete search history.

(56) References Cited

U.S. PATENT DOCUMENTS 5,193,669 A * 3/1993 Demeo ..... H01H 13/7006 200/302.2
5,561,278 A * 10/1996 Rutten ..... H01H 13/702 200/5 A
2010/0066572 A1* 3/2010 Dietz ..... H01H 13/702 341/34
2011/0073458 A1* 3/2011 han ..... H01H 13/702 200/5 A
2012/0024682 A1* 2/2012 Huang ..... G06F 3/0202 200/5 A
2014/0306895 A1* 10/2014 Lee ..... G06F 3/0233 345/168
2017/0032909 A1* 2/2017 Chen ..... H01H 13/7065

* cited by examiner

*Primary Examiner* — Ahmed M Saeed
(74) *Attorney, Agent, or Firm* — Kirton McConkie; Evan R. Witt

(57) ABSTRACT

A keyboard device includes plural keys, a supporting plate and a membrane switch circuit member. The membrane switch circuit member includes a first board, a second board, a third board and a fourth board. The first board includes plural first contacts. The second board includes plural second contacts and plural first openings. The third board includes plural third contacts and plural second openings. The fourth board includes plural fourth contacts. The plural first contacts, the plural first openings and the plural third contacts are collaboratively defined as a first key matrix. The plural second contacts, the plural second openings and the plural fourth contacts are collaboratively defined as a second key matrix.

10 Claims, 6 Drawing Sheets

KEYBOARD DEVICE

FIELD OF THE INVENTION

The present invention relates to a keyboard device, and more particularly to a keyboard device with a membrane switch circuit member.

BACKGROUND OF THE INVENTION

Generally, the widely-used peripheral input device of a computer system includes for example a mouse device, a keyboard device, a trackball device, or the like. Via the keyboard device, characters or symbols can be directly inputted into the computer system. As a consequence, most users and most manufacturers of input devices pay much attention to the development of keyboard devices.

A keyboard device with scissors-type connecting elements will be described as follow. FIG. 1 is a schematic cross-sectional view illustrating a conventional keyboard device. The conventional keyboard device 1 comprises plural keys 10, a membrane switch circuit member 11 and a supporting plate 12. Each key 10 comprises a keycap 101, a scissors-type connecting element 102 and an elastic element 103. In the key 10, the keycap 101 is exposed outside the conventional keyboard device 1. Consequently, the keycap 101 can be depressed by the user. The scissors-type connecting element 102 is used for connecting the keycap 101 and the supporting plate 12. The elastic element 103 is penetrated through the scissors-type connecting element 102. In addition, both ends of the elastic element 103 are contacted with the keycap 101 and the membrane switch circuit member 11, respectively. The supporting plate 12 is located under the membrane switch circuit member 11. The keycap 101, the scissors-type connecting element 102, the elastic element 103 and the membrane switch circuit member 11 are supported on the supporting plate 12.

The membrane switch circuit member 11 comprises an upper wiring board 111, a separation layer 112, and a lower wiring board 113. The upper wiring board 111 has plural upper contacts 1111. The separation layer 112 is located under the upper wiring board 111, and comprises plural perforations 1121 corresponding to the plural upper contacts 1111. The lower wiring board 113 is located under the separation layer 112, and comprises plural lower contacts 1131 corresponding to the plural upper contacts 1111. The plural lower contacts 1131 and the plural upper contacts 1111 are collectively defined as plural key switches 114. The elastic elements 103 are disposed on the membrane switch circuit member 11 and aligned with the corresponding key switches 114.

The operations of the key 10 of the conventional keyboard device 1 in response to the depressing action of the user will be illustrated as follows. Please refer to FIG. 1 again. When the keycap 101 is depressed, the keycap 101 is moved downwardly to push the scissors-type connecting element 102 in response to the depressing force. As the keycap 101 is moved downwardly relative to the supporting plate 12, the keycap 101 pushes the corresponding elastic element 103. At the same time, the elastic element 103 is subjected to deformation to push the membrane switch circuit member 11 and trigger the corresponding key switch 114 of the membrane switch circuit member 11. Consequently, the membrane switch circuit member 11 generates a corresponding key signal. When the keycap 101 is no longer depressed by the user, no external force is applied to the keycap 101 and the elastic element 103 is no longer pushed by the keycap 101. In response to the elasticity of the elastic element 103, the elastic element 103 is restored to its original shape to provide an upward elastic restoring force. Consequently, the keycap 101 is returned to its original position where it is not depressed. The structures and the operations of the conventional keyboard device have been mentioned as above.

Conventionally, the keys of the keyboard device are arranged in a keyboard matrix. When one key is depressed, a keyboard controller realizes the information of the depressed key according to the column information and the row information and outputs the corresponding key signal. Generally, the intersection between each row and each column of the keyboard matrix represents a corresponding key intersection. When one keycap is triggered, the keyboard device starts to scan the keyboard matrix and recognizes which keycap is depressed. For example, the keyboard controller scans all columns of the keyboard matrix sequentially. If the corresponding signal is received from a specified row when a specified column is scanned by the keyboard controller, the keyboard controller can realize which key is depressed according to the received column information and row information.

The minimum matrix unit of the keyboard matrix is composed of four keys. When any of the four keys is depressed, the corresponding key signal can be successfully generated. When two of the four keys are arbitrarily depressed, the keyboard controller can realize which keys are triggered according to the column information and the row information. However, when three keys are simultaneously depressed, the information of two rows and the information of two columns are transmitted to the keyboard controller. Since four keys are defined by two rows and two columns, the keyboard controller cannot recognize the three depressed keys from the four keys according to the column information and the row information only. Under this circumstance, the fourth key is erroneously judged as the on-state key. That is, the fourth key is referred as a ghost key.

For avoiding the ghosting problem, some approaches have been disclosed. In accordance with a first approach, the keyboard device is further equipped with plural diodes near the corresponding key intersections. Since the current is allowed to pass through the membrane switch circuit member in one direction through the arrangement of the diodes, the erroneous judgement of the ghosting problem is avoided. However, the approach of installing diodes near the corresponding key intersection still has some drawbacks. Firstly, the diode is not cost-effective. Consequently, the cost of the keyboard device is increased. Secondly, the plural diodes on the membrane switch circuit member increase the thickness of the membrane switch circuit member. The increased thickness of the membrane switch circuit member is detrimental to the slimness of the keyboard device. Thirdly, the process of welding the diodes at the positions near the corresponding key intersections is very complicated.

In accordance with a second approach, the keyboard device is not equipped with the keyboard matrix. The output wire of each key is connected with a microprocessor of the keyboard device. Since this approach needs a great number of output wires, it is difficult to install the output circuits. For example, in case that the keyboard device contains 144 keys, the keyboard device comprises 144 output wires. Consequently, it is difficult to install so many output circuits.

Therefore, there is a need of providing a keyboard device with low cost and capable of avoiding the ghosting problem.

SUMMARY OF THE INVENTION

An object of the present invention provides a keyboard device with low cost and capable of avoiding the ghosting problem.

In accordance with an aspect of the present invention, there is provided a keyboard device. The keyboard device includes at least one key and a membrane switch circuit member. The at least one key is exposed outside the keyboard device. The membrane switch circuit member is located under the at least one key. When the membrane switch circuit member is pressed by the at least one key, at least one key signal is correspondingly generated. The membrane switch circuit member includes a first board, a second board, a third board and a fourth board. The first board is located under the at least one key, and includes at least one first contact. The second board is located under the first board, and includes at least one second contact and at least one first opening. The third board is located under the second board, and includes at least one third contact and at least one second opening. The fourth board is located under the third board, and includes at least one fourth contact. The at least one first contact, the at least one first opening and the at least one third contact are collaboratively defined as a first key matrix. The at least one second contact, the at least one second opening and the at least one fourth contact are collaboratively defined as a second key matrix.

In an embodiment, the at least one first contact, the at least one first opening, the at least one second opening and the at least one fourth contact are collaboratively defined as a third key matrix.

In accordance with another aspect of the present invention, there is provided a keyboard device. The keyboard device includes at least one key and a membrane switch circuit member. The at least one key is exposed outside the keyboard device. The membrane switch circuit member is located under the at least one key. When the membrane switch circuit member is pressed by the at least one key, at least one key signal is correspondingly generated. The membrane switch circuit member includes a first board, a second board, a third board and a fourth board. The first board is located under the at least one key, and includes at least one first contact. The second board is located under the first board, and includes at least one second contact and at least one first opening. The third board is located under the second board, and includes at least one third contact and at least one second opening. The fourth board is located under the third board, and includes at least one fourth contact. The at least one first contact, the at least one first opening and the at least one third contact are collaboratively defined as a first key matrix. The at least one first contact, the at least one first opening, the at least one second opening and the at least one fourth contact are collaboratively defined as a second key matrix.

In an embodiment, the at least one second contact, the at least one second opening and the at least one fourth contact are collaboratively defined as a third key matrix.

In accordance with a further aspect of the present invention, there is provided a keyboard device. The keyboard device includes at least one key and a membrane switch circuit member. The at least one key is exposed outside the keyboard device. The membrane switch circuit member is located under the at least one key. When the membrane switch circuit member is pressed by the at least one key, at least one key signal is correspondingly generated. The membrane switch circuit member includes a first board, a second board, a third board and a fourth board. The first board is located under the at least one key, and includes at least one first contact. The second board is located under the first board, and includes at least one second contact and at least one first opening. The third board is located under the second board, and includes at least one third contact and at least one second opening. The fourth board is located under the third board, and includes at least one fourth contact. The at least one second contact, the at least one second opening and the at least one fourth contact are collaboratively defined as a first key matrix. The at least one first contact, the at least one first opening, the at least one second opening and the at least one fourth contact are collaboratively defined as a second key matrix.

In an embodiment, the at least one first contact, the at least one first opening and the at least one third contact are collaboratively defined as a third key matrix.

From the above descriptions, the membrane switch circuit member of the keyboard device comprises at least four boards to install various key matrices. Consequently, the plural keys are constituted by various key matrices. Since the conducting lines of different key matrices are independent from each other, the ghosting problem can be overcome. In comparison with the first approach of the conventional technology, it is not necessary to install a great number of diodes in the keyboard device of the present invention. Consequently, the keyboard device of the present invention is cost-effective and capable of avoiding the ghosting problem. In comparison with the second approach of the conventional technology, the keyboard device of the present invention has less number of conducting lines. Consequently, the wiring method of the output circuit is simplified.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For solving the drawbacks of the conventional technologies, the present invention provides a keyboard device.

Figure 1:
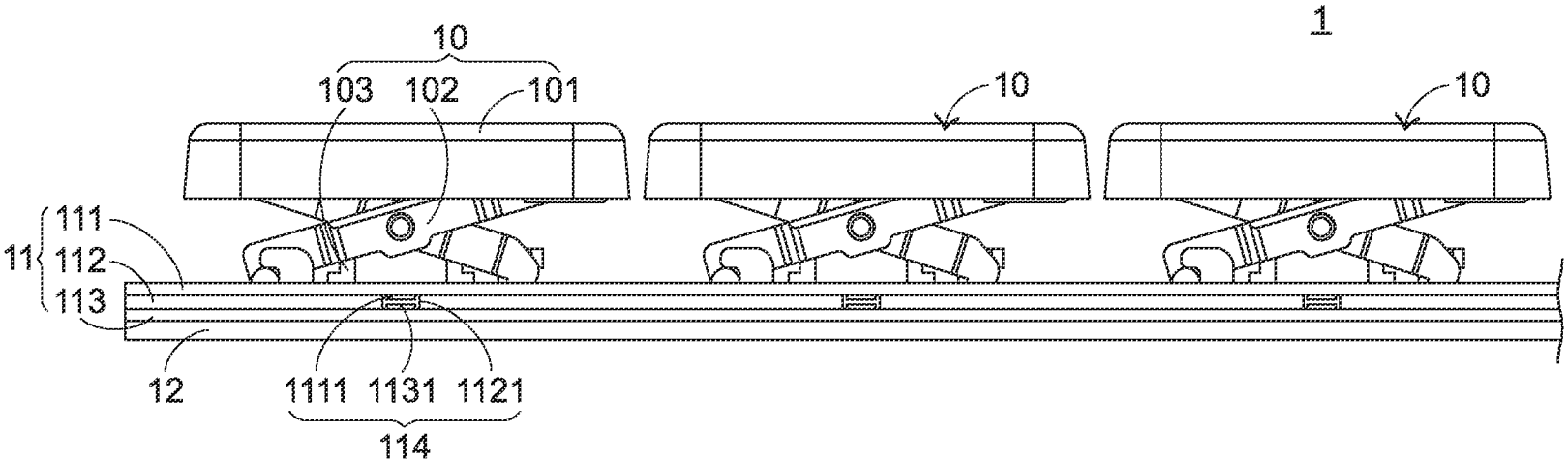
FIG.1 PRIOR ART
FIG. 1 is a schematic cross-sectional view illustrating a conventional keyboard device.
Figure 2:
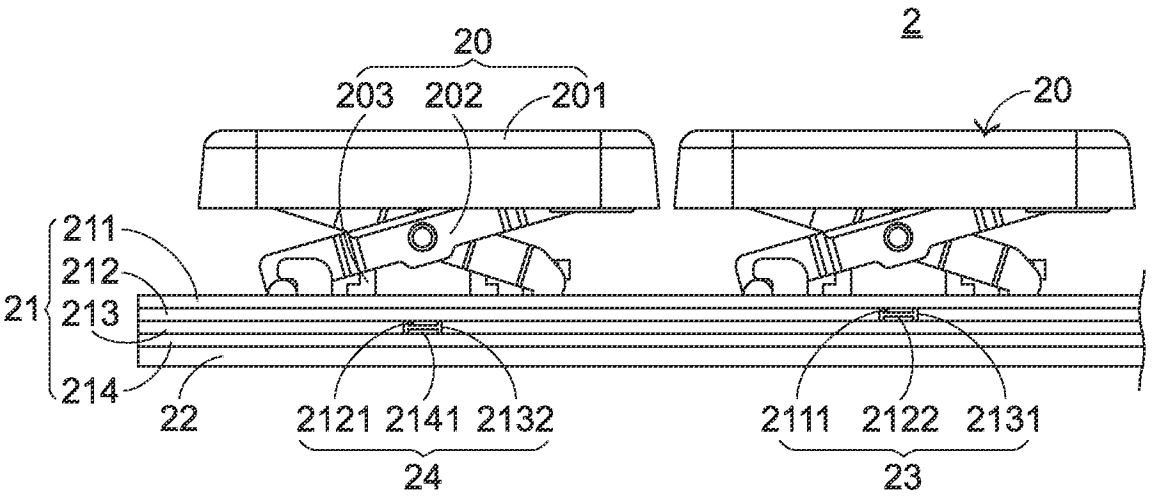
FIG. 2 is a schematic exploded view illustrating a portion of a keyboard device according to a first embodiment of the present invention.

The structure of a keyboard device of the present invention will be described as follow. FIG. 2 is a schematic exploded view illustrating a portion of a keyboard device according to a first embodiment of the present invention. The keyboard device 2 comprises plural keys 20, a membrane switch circuit member 21 and a supporting plate 22. The plural keys 20 are exposed to a top surface of the keyboard device 2 and connected with the supporting plate 22. When one of the keys 20 is depressed, the key 20 is moved downwardly relative to the supporting plate 22. Each key 20 comprises a keycap 201, a connecting element 202 and an elastic element 203. The keycap 201 is exposed outside the top surface of the keyboard device 2 so as to be depressed by the user. The connecting element 202 is arranged between the supporting plate 22 and the corresponding keycap 201. The connecting element 202 is used for connecting the supporting plate 22 and the keycap 201 and allowing the keycap 201 to be moved upwardly or downwardly relative to the supporting plate 22. The elastic element 203 is disposed under the corresponding keycap 201 and penetrated through the corresponding connecting element 202. The elastic element 203 is used for providing an elastic force to the keycap 201. In response to the elastic force, the keycap 201 is moved upwardly and returned to its original position.

Figure 3:
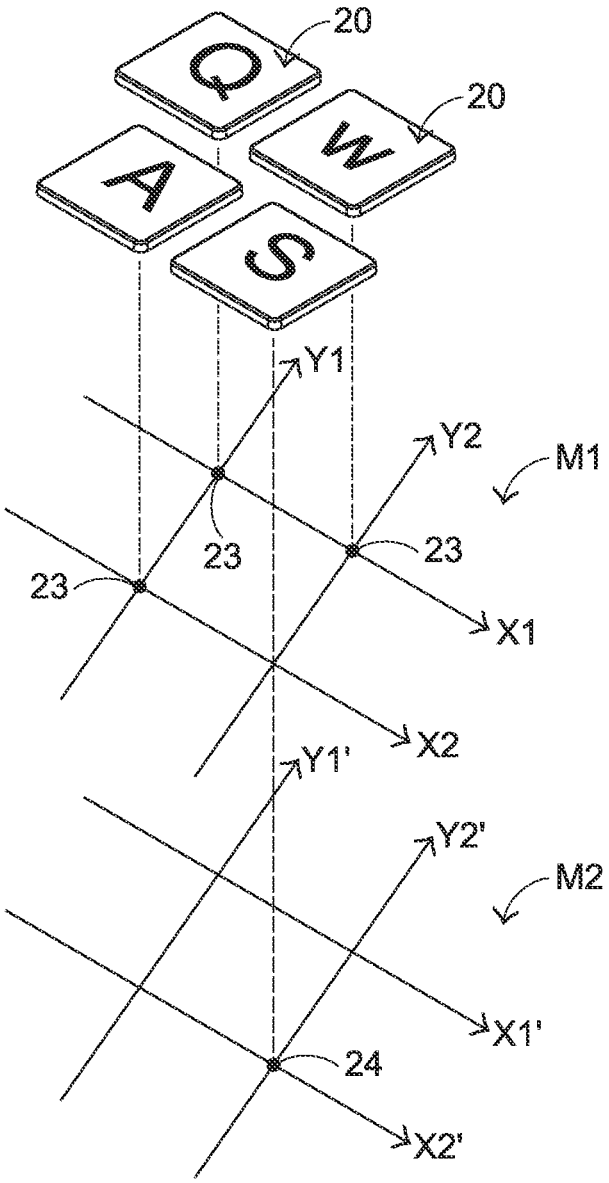
FIG. 3 schematically illustrates some keys of the keyboard device according to the first embodiment of the present invention.

The membrane switch circuit member 21 is arranged between the supporting plate 22 and the plural keys 20. When the membrane switch circuit member 21 is pressed by one of the keys 20, a corresponding key signal is generated. The supporting plate 22 is located under the membrane switch circuit member 21. The plural keys 20 and the membrane switch circuit member 21 are supported by the supporting plate 22. As shown in FIG. 3, the supporting plate 22 comprises plural hooks (not shown) corresponding to the keys 20. The hooks are connected with the corresponding connecting elements 202, so that the keycaps 201 are fixed on the supporting plate 22.

In this embodiment, the keyboard device 2 is a keyboard device for a notebook computer. Moreover, the connecting element 202 is a scissors-type connecting element (also referred as a scissors member) that is swung with the movement of the keycap 201. Moreover, the elastic element 203 is a rubbery elastomer. The examples of the above components are presented herein for purpose of illustration and description only. In another embodiment, the crater-shaped connecting elements for a desktop computer can be used to connect and move the keycaps. In a further embodiment, the keycaps are moved upwardly or downwardly in response to magnetic forces.

The structure of the membrane switch circuit member 21 will be described in more details as follows. As shown in FIG. 2, the membrane switch circuit member 21 comprises a first board 211, a second board 212, a third board 213 and a fourth board 214. The first board 211 is located under the elastic elements 203 of the plural keys 20. The first board 211 comprises plural first contacts 2111. The plural first contacts 2111 are connected with each other through plural first conducting lines. For succinctness, the first conducting lines are not shown in FIG. 2. The plural first contacts 2111 and the plural keys 20 are not in a one-to-one arrangement.

The second board 212 is located under the first board 211. The second board 212 comprises plural second contacts 2121 and plural first openings 2122. The plural first openings 2122 are aligned with the corresponding first contacts 2111, respectively. The plural second contacts 2121 are connected with each other through plural second conducting lines. For succinctness, the second conducting lines are not shown in FIG. 2. The plural second contacts 2121 (and the plural first openings 2122) and the plural keys 20 are not in a one-to-one arrangement.

The third board 213 is located under the second board 212. The third board 213 comprises plural third contacts 2131 and plural second openings 2132. The plural third contacts 2131 are aligned with the corresponding first contacts 2111 and the corresponding first openings 2122, respectively. The plural second openings 2132 are aligned with the corresponding second contacts 2121, respectively. The plural third contacts 2131 are connected with each other through plural third conducting lines. For succinctness, the third conducting lines are not shown in FIG. 2. The plural third contacts 2131 (and the plural second openings 2132) and the plural keys 20 are not in a one-to-one arrangement.

The fourth board 214 is located under the third board 213. The fourth board 214 comprises plural fourth contacts 2141. The plural fourth contacts 2141 are aligned with the corresponding second contacts 2121 and the corresponding second openings 2132, respectively. The plural fourth contacts 2141 are connected with each other through plural fourth conducting lines. For succinctness, the fourth conducting lines are not shown in FIG. 2. The plural fourth contacts 2141 and the plural keys 20 are not in a one-to-one arrangement.

Moreover, one first contact 2111, one first opening 2122 and one third contact 2131 of the switch circuit member 21 are collaboratively formed as a first key switch 23. The plural first contacts 2111 of the first board 211, the plural first openings 2122 of the second board 212 and the plural third contacts 2131 of the third board 213 are formed as plural first key switches 23. These first key switches 23 are collaboratively formed as a first key matrix M1 (see FIG. 3). Similarly, one second contact 2121, one second opening 2132 and one fourth contact 2141 are collaboratively formed as a second key switch 24. The plural second contacts 2121 of the second board 212, the plural second openings 2132 of the third board 213 and the plural fourth contacts 2141 of the fourth board 214 are formed as plural second key switches 24. These second key switches 24 are collaboratively formed as a second key matrix M2 (see FIG. 3).

The keyboard device 2 of the present invention is capable of avoiding the ghosting problem. The principles of avoiding the ghosting problem will be illustrated with reference to FIGS. 2 and 3. FIG. 3 schematically illustrates some keys of the keyboard device according to the first embodiment of the present invention.

Some keys 20 of the keyboard device 2 are shown in FIG. 3. For example, these keys 20 includes the key "Q", the key "W", the key "A" and the key "S". The plural first key switches 23 of the key "Q", the key "W" and the key "A" are defined by plural first conducting lines X1, X2 and plural third conducting lines Y1, Y2. The plural first key switches 23 are constituted as a part of the first key matrix M1. The second key switch 24 of the key "S" is defined by a second conducting line X2' and a fourth conducting line Y2'. The second key switch 24 is a part of the second key matrix M2.

When the key "Q" is depressed by the user, the components corresponding to the key "Q" are enabled to trigger the corresponding first key switch 23. The operations of these components are similar to those of the conventional technology, and are not redundantly described herein. Since the first key switch 23 corresponding to the key "Q" is triggered, the first conducting line X1 and the third conducting line Y1 generate a corresponding key signal. In other words, the key signal corresponding to the first conducting line X1 and the third conducting line Y1 is outputted from the keyboard device 2 to a computer (not shown), which is in communication with the keyboard device 2. According to the key signal corresponding to the first conducting line X1 and the third conducting line Y1, the computer realizes that the depressed key 20 is the key "Q". Consequently, a command corresponding to the key "Q" is executed by the computer.

When the key "W" is depressed by the user, the components corresponding to the key "W" are enabled to trigger the corresponding first key switch 23. Since the first key switch 23 corresponding to the key "Q" is triggered, the first conducting line X1 and the third conducting line Y2 generate a corresponding key signal. In other words, the key signal corresponding to the first conducting line X1 and the third conducting line Y2 is outputted from the keyboard device 2 to the computer. According to the key signal corresponding to the first conducting line X1 and the third conducting line Y2, the computer realizes that the depressed key 20 is the key "W". Consequently, a command corresponding to the key "W" is executed by the computer.

When the key "A" is depressed by the user, the components corresponding to the key "A" are enabled to trigger the corresponding first key switch 23. Since the first key switch 23 corresponding to the key "A" is triggered, the first conducting line X2 and the third conducting line Y1 generate a corresponding key signal. In other words, the key signal corresponding to the first conducting line X2 and the third conducting line Y1 is outputted from the keyboard device 2 to the computer. According to the key signal corresponding to the first conducting line X2 and the third conducting line Y1, the computer realizes that the depressed key 20 is the key "A". Consequently, a command corresponding to the key "A" is executed by the computer.

When the key "S" is depressed by the user, the components corresponding to the key "S" are enabled to trigger the corresponding second key switch 24. Since the second key switch 24 corresponding to the key "S" is triggered, the second conducting line X2' and the fourth conducting line Y2' generate a corresponding key signal. In other words, the key signal corresponding to the second conducting line X2' and the fourth conducting line Y2' is outputted from the keyboard device 2 to the computer. According to the key signal corresponding to the second conducting line X2' and the fourth conducting line Y2', the computer realizes that the depressed key 20 is the key "S". Consequently, a command corresponding to the key "S" is executed by the computer.

From the above descriptions, the plural keys 20 of the keyboard device 2 are constituted by the first key matrix M1 and the second key matrix M2. When the plural first conducting lines X1, X2 and the plural third conducting lines Y1, Y2 are triggered, the first key switches 23 of the first key matrix M1 are electrically conducted. When the plural second conducting lines X1', X2' and the plural fourth conducting lines Y1', Y2' are triggered, the second key switches 24 of the second key matrix M2 are electrically conducted. Since the conducting lines of all keys 20 of the keyboard device 2 are not overlapped, the ghosting problem can be overcome.

Figure 4:
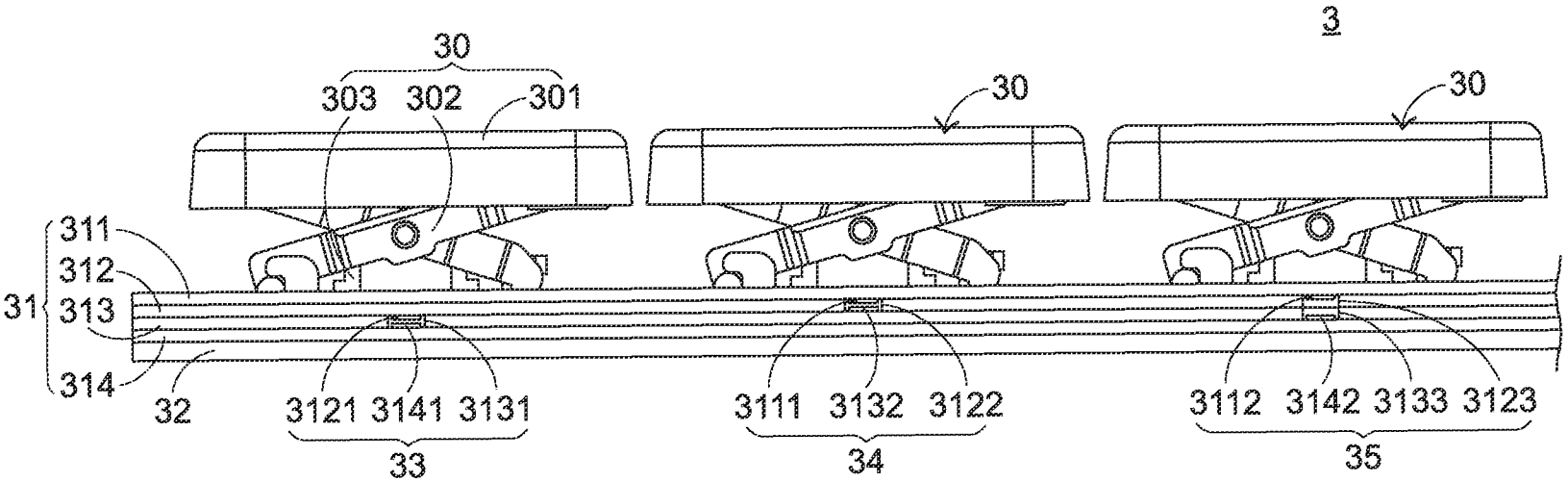
FIG. 4 is a schematic cross-sectional view illustrating a portion of a keyboard device according to a second embodiment of the present invention.

The present invention further provides a second embodiment, which is distinguished from the first embodiment. FIG. 4 is a schematic cross-sectional view illustrating a portion of a keyboard device according to a second embodiment of the present invention. The keyboard device 3 comprises plural keys 30, a membrane switch circuit member 31 and a supporting plate 32. Each key 30 comprises a keycap 301, a connecting element 302 and an elastic element 303. The membrane switch circuit member 31 comprises a first board 311, a second board 312, a third board 313 and a fourth board 314. Except for the structure of the membrane switch circuit member 31, the structures and functions of the other components are similar to those of the keyboard device 2 of the first embodiment.

The structure of the membrane switch circuit member 31 will be described in more details as follows. The first board 311 comprises plural first contacts 3111 and plural second contacts 3112. The plural first contacts 3111 are connected with each other through plural first conducting lines. For succinctness, the first conducting lines are not shown in FIG. 4. The plural second contacts 3112 are connected with each other through plural second conducting lines. For succinctness, the second conducting lines are not shown in FIG. 4.

The second board 312 is located under the first board 311. The second board 312 comprises plural third contacts 3121, plural first openings 3122 and plural second openings 3123. The plural first openings 3122 are aligned with the corresponding first contacts 3111, respectively. The plural second openings 3123 are aligned with the corresponding second contacts 3112, respectively. The plural third contacts 3121 are connected with each other through plural third conducting lines. For succinctness, the third conducting lines are not shown in FIG. 4.

The third board 313 is located under the second board 312. The third board 313 comprises plural third openings 3131, plural fourth contacts 3132 and plural fourth openings 3133. The plural third openings 3131 are aligned with the corresponding third contacts 3121, respectively. The plural fourth openings 3133 are aligned with the plural second contacts 3112, respectively. The plural fourth contacts 3132 are aligned with the corresponding first contacts 3111 and the corresponding first openings 3122, respectively. The plural fourth contacts 3132 are connected with each other through plural fourth conducting lines. For succinctness, the fourth conducting lines are not shown in FIG. 4.

The fourth board 314 is located under the third board 313. The fourth board 314 comprises plural fifth contacts 3141 and plural sixth contacts 3142. The plural fifth contacts 3141 are aligned with the corresponding third contacts 3121 and the corresponding third openings 3131, respectively. The plural sixth contacts 3142 are aligned with the corresponding second contacts 3112, the corresponding second openings 3123 and the corresponding fourth openings 3133, respectively. The plural fifth contacts 3141 are connected with each other through plural fifth conducting lines. For succinctness, the fifth conducting lines are not shown in FIG. 4. The plural sixth contacts 3142 are connected with each other through plural sixth conducting lines. For succinctness, the sixth conducting lines are not shown in FIG. 4.

Moreover, one first contact 3111, one first opening 3122 and one fourth contacts 3132 of the switch circuit member 31 are collaboratively formed as a first key switch 33. The plural first contacts 3111 of the first board 311, the plural first openings 3122 of the second board 312 and the plural fourth contacts 3132 of the third board 313 are formed as plural first key switches 33. These first key switches 33 are collaboratively formed as a first key matrix (not shown). Similarly, one third contact 3121, one third opening 3131 and one fifth contact 3141 are collaboratively formed as a second key switch 34. The plural third contacts 3121 of the second board 312, the plural third openings 3131 of the third board 313 and the plural fifth contacts 3141 of the fourth board 314 are formed as plural second key switches 34. These second key switches 34 are collaboratively formed as a second key matrix (not shown). Similarly, one second contact 3112, one second opening 3123, one fourth opening 3133 and one sixth contact 3142 are collaboratively formed as a third key switch 35. The plural second contacts 3112 of the first board 311, the plural second openings 3123 of the second board 312, the plural fourth openings 3133 and the plural sixth contacts 3142 are formed as plural third key switches 35. These third key switches 35 are collaboratively formed as a third key matrix (not shown).

From the above descriptions, the plural keys 30 of the keyboard device 3 are constituted by the first key matrix, the second key matrix and the third matrix. When the first conducting lines and the fourth conducting lines are triggered, the first key switches 33 of the first key matrix are electrically conducted. When the third conducting lines and the fifth conducting lines are triggered, the second key switches 34 of the second key matrix are electrically conducted. When the second conducting lines and the sixth conducting lines are triggered, the third key switches 35 of the third key matrix are electrically conducted. In comparison with the keyboard device 2 of the above embodiment, the keyboard device 3 of this embodiment can be equipped with more keys 30 to avoid the ghosting problem.

Figure 5A:
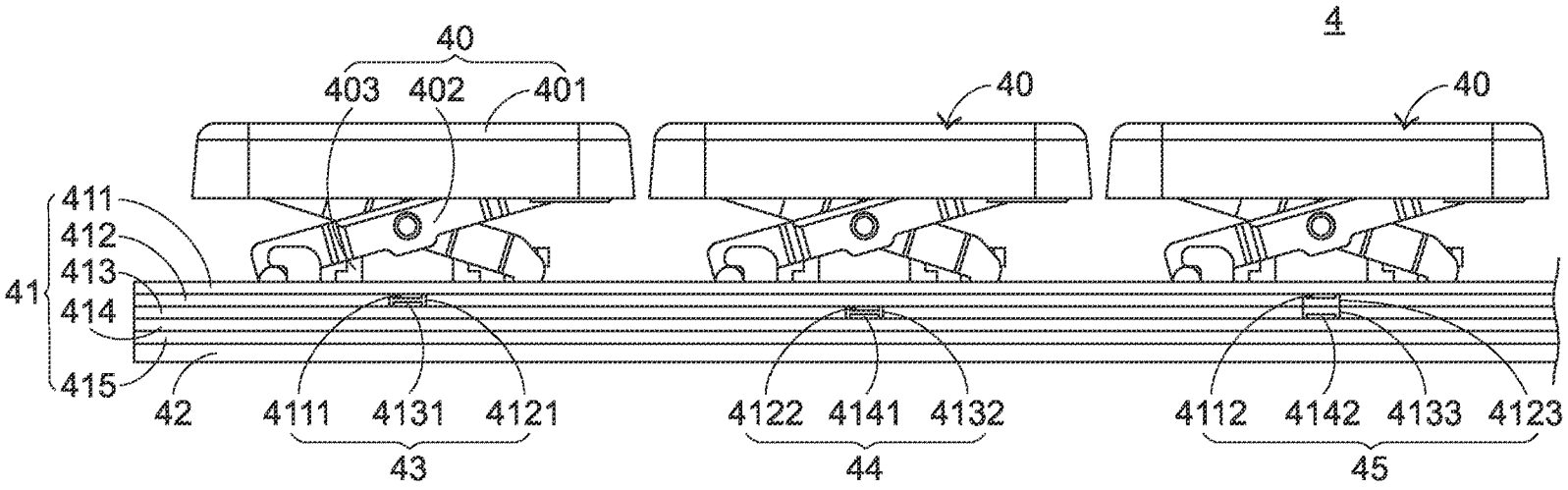
FIG. 5A is a schematic cross-sectional view illustrating a portion of a keyboard device according to a third embodiment of the present invention.
Figure 5B:
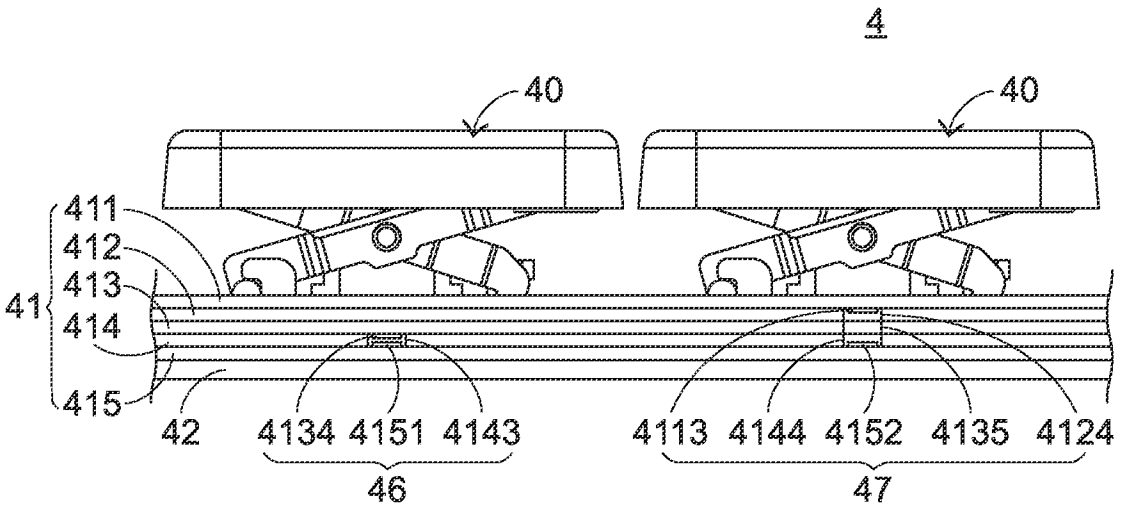
FIG. 5B is a schematic cross-sectional view illustrating another portion of a keyboard device according to a third embodiment of the present invention.

The present invention further provides a third embodiment, which is distinguished from the above embodiments. Please refer to FIGS. 5A and 5B. FIG. 5A is a schematic cross-sectional view illustrating a portion of a keyboard device according to a third embodiment of the present invention. FIG. 5B is a schematic cross-sectional view illustrating another portion of a keyboard device according to a third embodiment of the present invention. The keyboard device 4 comprises plural keys 40, a membrane switch circuit member 41 and a supporting plate 42. Each key 40 comprises a keycap 401, a connecting element 402 and an elastic element 403. The membrane switch circuit member 41 comprises a first board 411, a second board 412, a third board 413, a fourth board 414 and a fifth board 415. Except for the structure of the membrane switch circuit member 41, the structures and functions of the other components are similar to those of the keyboard devices of the above embodiments.

The structure of the membrane switch circuit member 41 will be described in more details as follows. The first board 411 comprises plural first contacts 4111, plural second contacts 4112 and plural third contacts 4113. The plural first contacts 4111 are connected with each other through plural first conducting lines. For succinctness, the first conducting lines are not shown in the drawings. The plural second contacts 4112 are connected with each other through plural second conducting lines. For succinctness, the second conducting lines are not shown in the drawings. The plural third contacts 4113 are connected with each other through plural third conducting lines. For succinctness, the third conducting lines are not shown in the drawings.

The second board 412 is located under the first board 411. The second board 412 comprises plural first openings 4121, plural fourth contacts 4122, plural second openings 4123 and plural third openings 4124. The plural first openings 4121 are aligned with the corresponding first contacts 4111, respectively. The plural second openings 4123 are aligned with the corresponding second contacts 4112, respectively. The plural third openings 4124 are aligned with the corresponding third contacts 4113. The plural fourth contacts 4122 are connected with each other through plural fourth conducting lines. For succinctness, the fourth conducting lines are not shown in the drawings.

The third board 413 is located under the second board 412. The third board 413 comprises plural fifth contacts 4131, plural fourth openings 4132, plural fifth openings 4133, plural sixth contacts 4134 and plural sixth openings 4135. The plural fifth contacts 4131 are aligned with the corresponding first contacts 4111 and the corresponding first openings 4121, respectively. The plural fourth openings 4132 are aligned with the corresponding fourth contacts 4122, respectively. The plural fifth openings 4133 are aligned with the corresponding second contacts 4112 and the corresponding second openings 4123, respectively. The plural sixth openings 4135 are aligned with the corresponding third contacts 4113 and the corresponding third openings 4124, respectively. The plural fifth contacts 4131 are connected with each other through plural fifth conducting lines. For succinctness, the fifth conducting lines are not shown in the drawings. The plural sixth contacts 4134 are connected with each other through plural sixth conducting lines. For succinctness, the sixth conducting lines are not shown in the drawings.

The fourth board 414 is located under the third board 413. The fourth board 414 comprises plural seventh contacts 4141, plural eighth contacts 4142, plural seventh openings 4143 and plural eighth openings 4144. The plural seventh contacts 4141 are aligned with the corresponding fourth contacts 4122 and the corresponding fourth openings 4132, respectively. The plural eighth contacts 4142 are aligned with the corresponding second contacts 4112, the corresponding second openings 4123 and the plural fifth openings 4133, respectively. The plural seventh openings 4143 are aligned with the corresponding sixth contacts 4134, respectively. The plural eighth openings 4144 are aligned with the corresponding third contacts 4113, the corresponding third openings 4124 and the corresponding sixth openings 4135, respectively. The plural seventh contacts 4141 are connected with each other through plural seventh conducting lines. For succinctness, the seventh conducting lines are not shown in the drawings. The plural eighth contacts 4142 are connected with each other through plural eighth conducting lines. For succinctness, the eighth conducting lines are not shown in the drawings.

The fifth board 415 is located under the fourth board 414. The fifth board 415 comprises plural ninth contacts 4151 and plural tenth contacts 4152. The plural ninth contacts 4151 are aligned with the corresponding sixth contacts 4134 and the corresponding seventh openings 4143. The plural tenth contacts 4152 are aligned with the corresponding third contacts 4113, the corresponding third openings 4124, the corresponding sixth openings 4135 and the corresponding eighth openings 4144. The plural ninth contacts 4151 are connected with each other through plural ninth conducting lines. For succinctness, the ninth conducting lines are not shown in the drawings. The plural tenth contacts 4152 are connected with each other through plural tenth conducting lines. For succinctness, the tenth conducting lines are not shown in the drawings.

Moreover, one first contact 4111, one first opening 4121 and one fifth contact 4131 are collaboratively formed as a first key switch 43. The plural first contacts 4111 of the first board 411, the plural first openings 4121 of the second board 412 and the plural fifth contacts 4131 of the third board 413 are formed as plural first key switches 43. These first key switches 43 are collaboratively formed as a first key matrix (not shown). Similarly, one fourth contact 4122, one fourth opening 4132 and one seventh contact 4141 are collaboratively formed as a second key switch 44. The plural fourth contacts 4122 of the second board 412, the plural fourth openings 4132 of the third board 413 and the plural seventh contacts 4141 of the fourth board 414 are formed as plural second key switches 44. These second key switches 44 are collaboratively formed as a second key matrix (not shown). Similarly, one second contact 4112, one second opening 4123, one fifth opening 4133 and one eighth contact 4142 are collaboratively formed as a third key switch 45. The plural second contacts 4112 of the first board 411, the plural second openings 4123 of the second board 412, the plural fifth openings 4133 of the third board 413 and the plural eighth contacts 4142 of the fourth board 414 are formed as plural third key switches 45. These third key switches 45 are collaboratively formed as a third key matrix (not shown).

Similarly, one sixth contact 4134, one seventh opening 4143 and one ninth contact 4151 are collaboratively formed as a fourth key switch 46. The plural sixth contacts 4134 of the third board 413, the plural seventh openings 4143 of the fourth board 414 and the plural ninth contacts 4151 of the fifth board 415 are formed as plural fourth key switches 46. These fourth key switches 46 are collaboratively formed as a fourth key matrix (not shown). Similarly, one third contact 4113, one third opening 4124, one sixth opening 4135, one eighth opening 4144 and one tenth contact 4152 are collaboratively formed as a fifth key switch 47. The plural third contacts 4113 of the first board 411, the plural third openings 4124 of the second board 412, the plural sixth openings 4135 of the third board 413, the plural eighth openings 4144 of the fourth board 414 and the plural tenth contacts 4152 of the fifth board 415 are formed as plural fifth key switches 47. These fifth key switches 47 are collaboratively formed as a fifth key matrix (not shown).

From the above descriptions, the plural keys 40 of the keyboard device 4 are constituted by the first key matrix, the second key matrix, the third matrix, the fourth matrix and the fifth matrix. When the first conducting lines and the fifth conducting lines are triggered, the first key switches 43 of the first key matrix are electrically conducted. When the fourth conducting lines and the seventh conducting lines are triggered, the second key switches 44 of the second key matrix are electrically conducted. When the second conducting lines and the eighth conducting lines are triggered, the third key switches 45 of the third key matrix are electrically conducted. When the sixth conducting lines and the ninth conducting lines are triggered, the fourth key switches 46 of the fourth key matrix are electrically conducted. When the third conducting lines and the tenth conducting lines are triggered, the fifth key switches 47 of the fifth key matrix are electrically conducted. In comparison with the keyboard device 2 of the above embodiment, the keyboard device 4 of this embodiment further comprises the fourth key matrix and the fifth key matrix. The keyboard device 4 of this embodiment can be equipped with more keys 40 to avoid the ghosting problem.

The following two aspects should be specially described. Firstly, the supporting plate of the keyboard device is not restrictedly located under the membrane switch circuit member. For example, the supporting plate may be located over the membrane switch circuit member according to the practical requirements. However, the supporting plate comprises supporting plate openings corresponding to the elastic elements. The elastic elements are penetrated through the supporting plate openings. Consequently, the membrane switch circuit member can be triggered by the elastic elements. Secondly, the plural key matrices of the keyboard device are not overlapped with each other. It is noted that the examples of the key matrices are not restricted. That is, the example of the key matrices may be varied according to the practical requirements.

From the above descriptions, the membrane switch circuit member of the keyboard device comprises at least four boards to install various key matrices. Consequently, the plural keys are constituted by various key matrices. Since the conducting lines of different key matrices are independent from each other, the ghosting problem can be overcome. In comparison with the first approach of the conventional technology, it is not necessary to install a great number of diodes in the keyboard device of the present invention. Consequently, the keyboard device of the present invention is cost-effective and capable of avoiding the ghosting problem. In comparison with the second approach of the conventional technology, the keyboard device of the present invention has less number of conducting lines. Consequently, the wiring method of the output circuit is simplified.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A keyboard device, comprising:

at least one key exposed outside the keyboard device; and a membrane switch circuit member located under the at least one key, wherein when the membrane switch circuit member is pressed by the at least one key, at least one key signal is correspondingly generated, wherein the membrane switch circuit member comprises:

a first board located under the at least one key, and comprising at least one first contact;

a second board located under the first board, and comprising at least one second contact and at least one first opening;

a third board located under the second board, and comprising at least one third contact and at least one second opening; and a fourth board located under the third board, and comprising at least one fourth contact, wherein the at least one first contact, the at least one first opening and the at least one third contact are collaboratively defined as a first key matrix, wherein the first key matrix comprises a first key switch, and the at least one second contact, the at least one second opening and the at least one fourth contact are collaboratively defined as a second key matrix, wherein the second key matrix comprises a second key switch, wherein the first and second key matrices are not overlapped with each other.

2. The keyboard device according to claim 1, wherein the at least one first contact, the at least one first opening, the at least one second opening and the at least one fourth contact are collaboratively defined as a third key matrix, wherein the third key matrix comprises a third key switch.

3. The keyboard device according to claim 1, wherein the keyboard device further comprises a supporting plate, and the supporting plate is located under the membrane switch circuit member, wherein each of the at least one key comprises:

a keycap exposed outside the keyboard device;

a scissors-type connecting element arranged between the supporting plate and the keycap, wherein the supporting plate and the keycap are connected with each other through the scissors-type connecting element, so that the keycap is movable upwardly or downwardly relative to the supporting plate; and an elastic element arranged between the keycap and the membrane switch circuit member, wherein while the keycap is depressed to push the elastic element, the membrane switch circuit member is pressed by the elastic element.

4. The keyboard device according to claim 1, wherein the keyboard device further comprises a fifth board, wherein the fifth board is located under the fourth board, the fifth board comprises at least fifth contact, and the fourth board comprises at least one third opening, wherein the at least one contact, the at least one opening, the at least one second opening, the at least one third opening and the at least one fifth contact are collaboratively defined as a third key matrix, wherein the third key matrix comprises a third key switch.

5. A keyboard device, comprising:

at least one key exposed outside the keyboard device; and a membrane switch circuit member located under the at least one key, wherein when the membrane switch circuit member is pressed by the at least one key, at least one key signal is correspondingly generated, wherein the membrane switch circuit member comprises:

a first board located under the at least one key, and comprising at least one first contact;

a second board located under the first board, and comprising at least one second contact and at least one first opening;

a third board located under the second board, and comprising at least one third contact and at least one second opening; and a fourth board located under the third board, and comprising at least one fourth contact, wherein the at least one first contact, the at least one first opening and the at least one third contact are collaboratively defined as a first key matrix, wherein the first key matrix comprises a first key switch, and the at least one first contact, the at least one first opening, the at least one second opening and the at least one fourth contact are collaboratively defined as a second key matrix, wherein the second key matrix comprises a second key switch, wherein the first and second key matrices are not overlapped with each other.

6. The keyboard device according to claim 5, wherein the at least one second contact, the at least one second opening and the at least one fourth contact are collaboratively defined as a third key matrix, wherein the third key matrix comprises a third key switch.

7. The keyboard device according to claim 5, wherein the keyboard device further comprises a supporting plate, and the supporting plate is located under the membrane switch circuit member, wherein each of the at least one key comprises:

a keycap exposed outside the keyboard device;

a scissors-type connecting element arranged between the supporting plate and the keycap, wherein the supporting plate and the keycap are connected with each other through the scissors-type connecting element, so that the keycap is movable upwardly or downwardly relative to the supporting plate; and an elastic element arranged between the keycap and the membrane switch circuit member, wherein while the keycap is depressed to push the elastic element, the membrane switch circuit member is pressed by the elastic element.

8. A keyboard device, comprising:

at least one key exposed outside the keyboard device; and a membrane switch circuit member located under the at least one key, wherein when the membrane switch circuit member is pressed by the at least one key, at least one key signal is correspondingly generated, wherein the membrane switch circuit member comprises:

a first board located under the at least one key, and comprising at least one first contact;

a second board located under the first board, and comprising at least one second contact and at least one first opening;

a third board located under the second board, and comprising at least one third contact and at least one second opening; and a fourth board located under the third board, and comprising at least one fourth contact, wherein the at least one second contact, the at least one second opening and the at least one fourth contact are collaboratively defined as a first key matrix, wherein the first key matrix comprises a first key switch, and the at least one first contact, the at least one first opening, the at least one second opening and the at least one fourth contact are collaboratively defined as a second key matrix, wherein the second key matrix comprises a second key switch, wherein the first and second key matrices are not overlapped with each other.

9. The keyboard device according to claim 8, wherein the at least one first contact, the at least one first opening and the at least one third contact are collaboratively defined as a third key matrix, wherein the third key matrix comprises a third key switch.

10. The keyboard device according to claim 8, wherein the keyboard device further comprises a supporting plate, and the supporting plate is located under the membrane switch circuit member, wherein each of the at least one key comprises:

a keycap exposed outside the keyboard device;

a scissors-type connecting element arranged between the supporting plate and the keycap, wherein the supporting plate and the keycap are connected with each other through the scissors-type connecting element, so that the keycap is movable upwardly or downwardly relative to the supporting plate; and an elastic element arranged between the keycap and the membrane switch circuit member, wherein while the keycap is depressed to push the elastic element, the membrane switch circuit member is pressed by the elastic element.

* * * * *